US006305470B1

(12) United States Patent
Woie

(10) Patent No.: US 6,305,470 B1
(45) Date of Patent: Oct. 23, 2001

(54) METHOD AND APPARATUS FOR PRODUCTION TESTING INVOLVING FIRST AND SECOND PERMEABLE FORMATIONS

(75) Inventor: Rune Woie, Hafrsfjord (NO)

(73) Assignee: Shore-Tec AS, Hafrsfjord (NO)

( * ) Notice: Subject to any disclaimer, the term of this patent is extended or adjusted under 35 U.S.C. 154(b) by 0 days.

(21) Appl. No.: 09/403,309

(22) PCT Filed: Apr. 6, 1998

(86) PCT No.: PCT/NO98/00114

§ 371 Date: Oct. 20, 1999

§ 102(e) Date: Oct. 20, 1999

(87) PCT Pub. No.: WO98/48416

PCT Pub. Date: Oct. 29, 1998

(30) Foreign Application Priority Data

Apr. 23, 1997 (NO) ..... 971859

(51) Int. Cl.[7] ..... E21B 47/00; E21B 49/08

(52) U.S. Cl. ..... 166/250.02; 166/66; 166/264; 166/306; 166/250.17

(58) Field of Search ..... 166/66, 100, 250.17, 166/250.07, 264, 306, 250.02; 73/152.29, 152.36

(56) References Cited

U.S. PATENT DOCUMENTS 3,194,312 * 7/1965 Thomas ..... 166/285
3,993,130 * 11/1976 Papp .
4,799,157 1/1989 Kucuk et al. .
4,803,873 2/1989 Ehlig-Economides .
5,247,829 9/1993 Ehlig-Economides .
5,337,821 8/1994 Peterson .
5,348,420 * 9/1994 Bernhardt ..... 405/52
5,549,159 * 8/1996 Shwe et al. ..... 166/250.02
5,551,516 * 9/1996 Norman et al. ..... 166/308

FOREIGN PATENT DOCUMENTS 0176410 4/1986 (EP) .
0481866 4/1992 (EP) .

* cited by examiner

*Primary Examiner*—David Bagnell
*Assistant Examiner*—Jennifer R. Dougherty
(74) *Attorney, Agent, or Firm*—Smith, Gambrell & Russell

(57) ABSTRACT

When production testing a permeable first formation, fluid flowing out from the first formation is subjected to a pressure measurement and a flow rate control. In order to avoid bringing up the fluid flowing out during the production test to a surface position, where the fluid's inherent explosion and fire risk as well as poisonousness could cause substantial problems, a fluid flow path is arranged for fluid transfer only between the first and second formations. The fluid flow path which, in a suitable apparatus, is constituted by a channel-forming pipe. From this channel, the second permeable formation receives the fluid and keeps it for some time. In the position of use, the apparatus is assigned sealing devices such as annulus packers, which are placed such that fluid flow between the formations is limited to only follow the fluid flow path.

14 Claims, 4 Drawing Sheets

Figure 1:
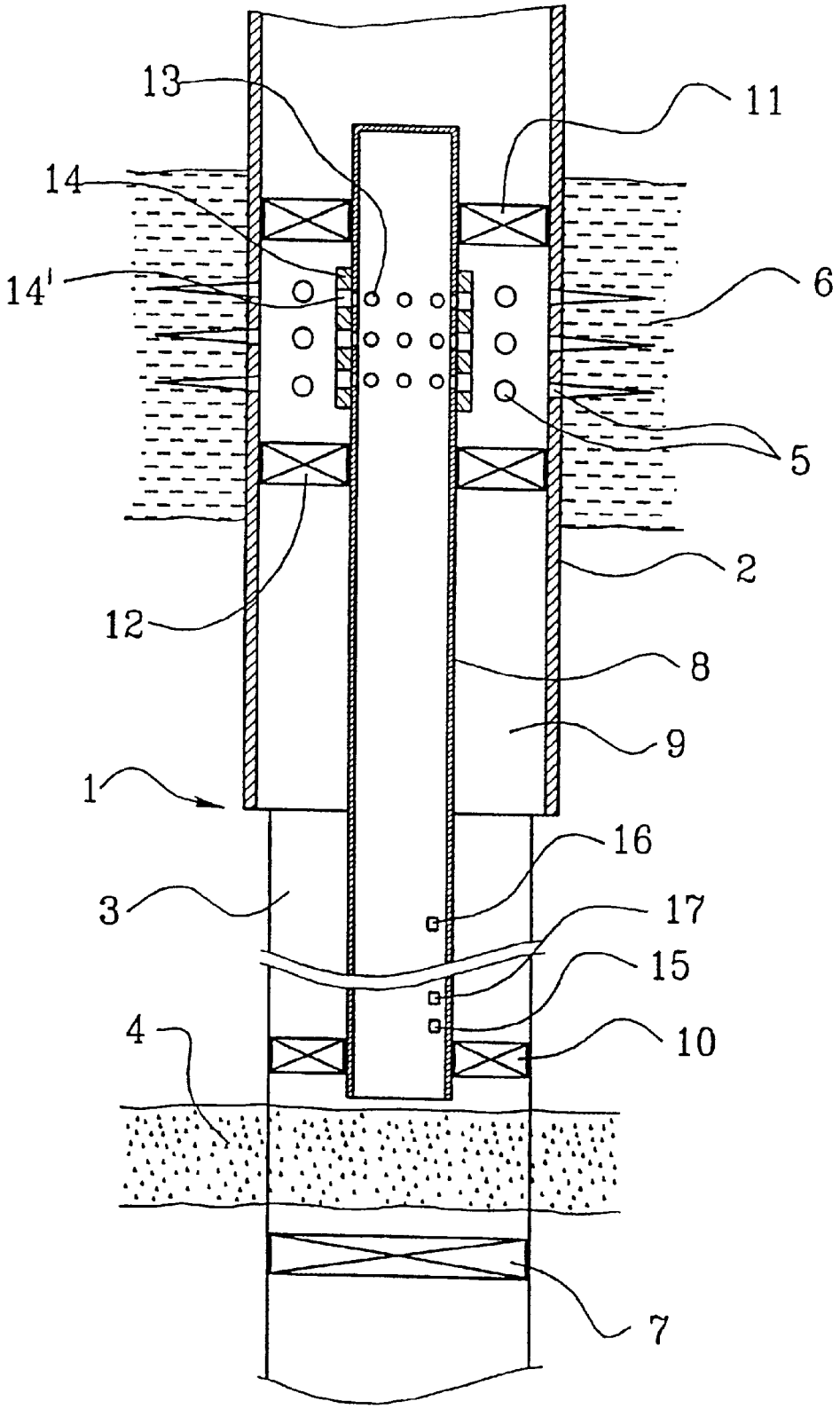

METHOD AND APPARATUS FOR PRODUCTION TESTING INVOLVING FIRST AND SECOND PERMEABLE FORMATIONS

FIELD OF THE INVENTION

This invention relates to a method and an apparatus for use in production testing of a formation expected to be permeable. After having pointed out the existence of hydrocarbons upon drilling for oil and gas, a so-called production test is carried out, in order to provide information about permeable layers outside the bore hole or well itself.

BACKGROUND OF THE INVENTION

Prior to a production test, when reservoir fluid is allowed to flow out of the formation, the well is provided with some equipment, including means to control the flow rate and measuring equipment to measure pressure and flow rate.

A production test has two phases, each with a duration of e.g. 4 hours. In both phases, a constant fluid flow is established from the formation.

In the beginning, it is fluid in the immediate neighbourhood of the well that flows into the well but, gradually, fluid from areas spaced at constantly larger distances from the well is drained off. The pressure within the well decreases due to the fact that the fluid must flow a constantly longer distance through the formation and, thus, is subjected to a constantly increasing pressure loss. Upon the maintenance of a constant flow rate, it is achieved that the course of pressure within the well only depends on the character of the formation, which can be examined. Therefore, the course of pressure, i.e. interdependent values for pressure and time, is recorded during the production test. In the second phase of the production test, following immediately after the first phase, the fluid low into the well is stopped.

Then, the pressure within the well will gradually increase to formation pressure as the formation around the well is refilled by means of the fluid flow into the well from remote areas. Also in this second phase, values for pressure and time are recorded.

Recorded pressure—time values in the two phases of the production test represent an important basis for subsequent analyses, appraisals and planning of further drilling activity and, possibly, development of an oil field. The question may well arise as to record other parameters, e.g. temperature, in addition to pressure and it is, of course, important to carry out chemical analyses of samples from the reservoir fluid.

Sealing means, e.g. in the form of annulus packers, are also adapted to take care of security requirements.

As explained below, the present invention is directed to a method and an apparatus for maintaining a constant flow of reservoir fluid in the well while pressure and, possibly, other parameters are read off.

By a production test it is known to conduct fluid from the reservoir to the surface through a so-called tubing, which is installed in the well. Sealing means are disposed within the annulus between the production tubing and the well wall, preferably on a place where a well casing has been installed, so that reservoir fluid is conducted to the surface through the tubing and not through the annulus. At the upper end thereof, the tubing is assigned a valve adapted to control the fluid flow, and sensors and measuring equipment are disposed, at least for allowing the reading off and recording time, flow rate in the tubing and pressure within the well.

It is known to install a downhole pump in order to achieve and maintain sufficient flow rate to carry out a production test if the pressure within the reservoir or the properties of the formation or reservoir fluid are such that this is required.

Even if the described technique is well developed and has been is known for many years, it still suffers from a plurality of disadvantages and deficiencies.

Reservoir fluid constitutes, when it reaches the surface, a safety risk due to danger of explosion, fire hazard and toxicity. Therefore, substantial security measures must be made in connection with a production test. Additionally, reservoir fluid constitutes an environmental problem because production tests naturally are carried out before one takes the costs of installing process equipment. Therefore, it has been customary to conduct reservoir fluid to a burner. Due to the fact that combustion causes unwanted release of environmental gases and release of uncontrolled amounts of hydrocarbons into the sea, there exist some places, such as on the Norwegian continental shelf, where, owing to restrictions on burning and limitation in periods during a year for testing, it has become interesting to collect produced reservoir fluid and convey it to a suitable process plant. Even if this is an environmentally satisfactory solution, it is, nevertheless, awkward, price-raising as well as exhibitting many restrictions both in time and with respect to weather conditions.

The preparations taking place before production testing comprise typically setting and cementing of casings for insulating various permeable layers, and to take care of safety requirements. Additionally, special production tubing is used down to the layer/bed to be tested. These preparations are time-consuming and expensive. Safety considerations make it some times necessary to strengthen an already set well casing, perhaps over the entire or a substantial part of the length of is the well; particularly in high pressure wells it might be required to install extra casings in the upper parts of the well.

It can be difficult to secure a good cementing, and it may arise channels, cracks or lack of cement. In many cases, it is difficult to define or measure the quality of the cement or the presence of cement. Unsatisfactory cementing causes great possibility for the occurrence of so-called cross flows to or from other permeable formations outside the casing. Cross flows may, to a high degree, influence the measurements carried out. Time-consuming and very expensive cementing repairs might be required in order to eliminate such sources of errors.

Today's system can take care of drilling of wells in deep waters, but does not provide a safe and secure production testing. In deep water, it is difficult to take care of security in case the drilling vessel drifts out of position, or whenever the riser is subjected to large, uncontrollable and not measurable vibrations or leeway. Such a situation requires a rapid disconnection of the riser or production tubing subsequently to the closing of the production valve at the seabed. Today's system is defective with respect to reacting on and pointing out dangerous situations.

Further, in ordinary production it is usual to use various forms of well stimulation. Such stimulation may consist in the addition of chemicals into the formation in order to increase the flow rate. A simple well stimulation consists in subjecting the formation to pressure pulses so that it cracks and, thus, becomes more permeable, so-called "fracturing" of the formation. A side-effect of fracturing can be a large increase in the amount of sand accompanying the reservoir fluid. In connection with production testing, it may in some relations be of interest to be able to effect a well stimulation in order to observe the effect thereof. Again, the case is such that an ordinary production equipment is adapted to avoid, withstand, resist and separate out sand, while corresponding measures are of less importance when carrying out a production test.

In some cases, it would be useful to be able to carry out a reversed production test, pumping produced fluid back into the formation again. However, this presupposes that produced fluid can be kept at approximate reservoir pressure and temperature. This will require extra equipment, and it will be necessary to use additional security measures. Further, it would require transfer of the production tubing. Probably, the production tubing would have to be pulled up and set once more, in order to give access to another formation. This is time-consuming as well as expensive. Therefore, it is not of actual interest to use such reversed production tests in connection with prior art technique. During a reversed production test, a pressure increase is observed in the well while a reversed constant fluid flow is maintained. When the reversed fluid flow is interrupted, a gradual pressure reduction will be observed in the well. Reversed production test may contribute to reveal a possible connection in the rock ground between formations connected by the channel, and may in some cases also contribute to define the distance from the well to such a possible connection between the formations.

SUMMARY OF THE INVENTION

The object of the invention is to provide a method and an apparatus for production testing a well where the described disadvantages of prior art technique have been avoided.

The object is achieved by means of features as defined in the following description and claims.

A main feature of the invention consists in that fluid is conducted from a first, expected permeable formation to a second permeable formation as opposed to prior art technique where fluid is conducted between a formation and the surface. According to the invention, prior to a production test, at least one channel connection is established between two formations, of which one (a first) formation is the one to be production tested. Further, sealing means are disposed to limit the fluid flow to take place only between the formations through the channel connection(s). When fluid flow takes place from first to second formation in an upward direction (the fluid flow may occur in the opposite direction, the formation being production tested then lying above said second, permeable formation accommodating the fluid flow), the sealing means, e.g. annulus packers, prevent fluid from flowing between the formations, outside the channel(s)

Within the channel, flow controlling means are disposed, inclusive a valve and, possibly, a pump, operable from the surface in order to control the fluid flow in the channel and, thus, between the formations. Further, within the channel, a sensor for flow rate in the channel is disposed. This sensor may, possibly, be readable from an surface position.

Additionally, sensors adapted to read pressure, temperature, detect sand, water and the like from the surface may be disposed. Of course, several sensors of each type may be disposed in order to monitor desired parameters at several places within the channel. As previously known, sensors for pressure and temperature are disposed within the well and, moreover, known equipment for timekeeping and recording of measuring values are used.

Upon a production test, by means of the flow rate sensor, the adjustable valve and, possibly, by means of said pump, a constant fluid flow is established and maintained in the channel, fluid flowing from one formation to the other formation. pressure and, possibly, other well parameters are read and recorded as previously known. Thereafter, the fluid flow is closed, and a pressure built up within the well is monitored and recorded as known. By means of the invention, a production test might be extended to comprise a reversed flow through the utilisation of a reversible pump, so that fluid can be pumped in the opposite direction between the two formations.

Storing produced reservoir fluid in a formation results in the advantage that the fluid may have approximately reservoir conditions when it is conducted back into the reservoir. Further, according to the invention, well stimulating measures in the formation being production tested may be used. Fracturing may be achieved as known per se. To this end, the well is supplied with pressurised liquid, e.g. through a drill string coupled to the channel. Thereafter, a production test is carried out, such as explained. Additionally, a reversed production test may alternately give both injection and production date from two separated layers without having to pull the test string.

BRIEF DESCRIPTION OF THE PREFERRED EMBODIMENTS

Figure 1A:
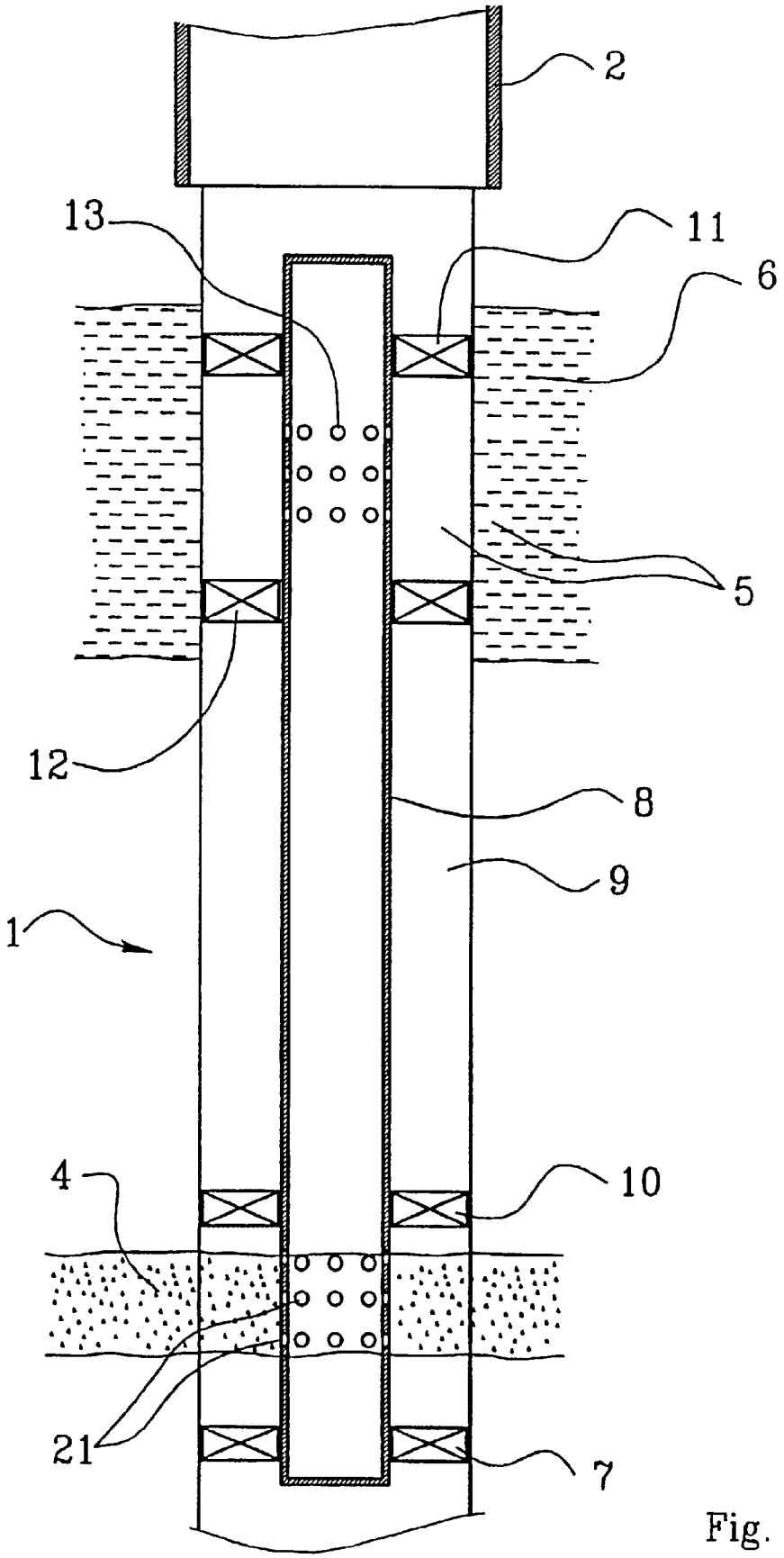
Figure 1B:
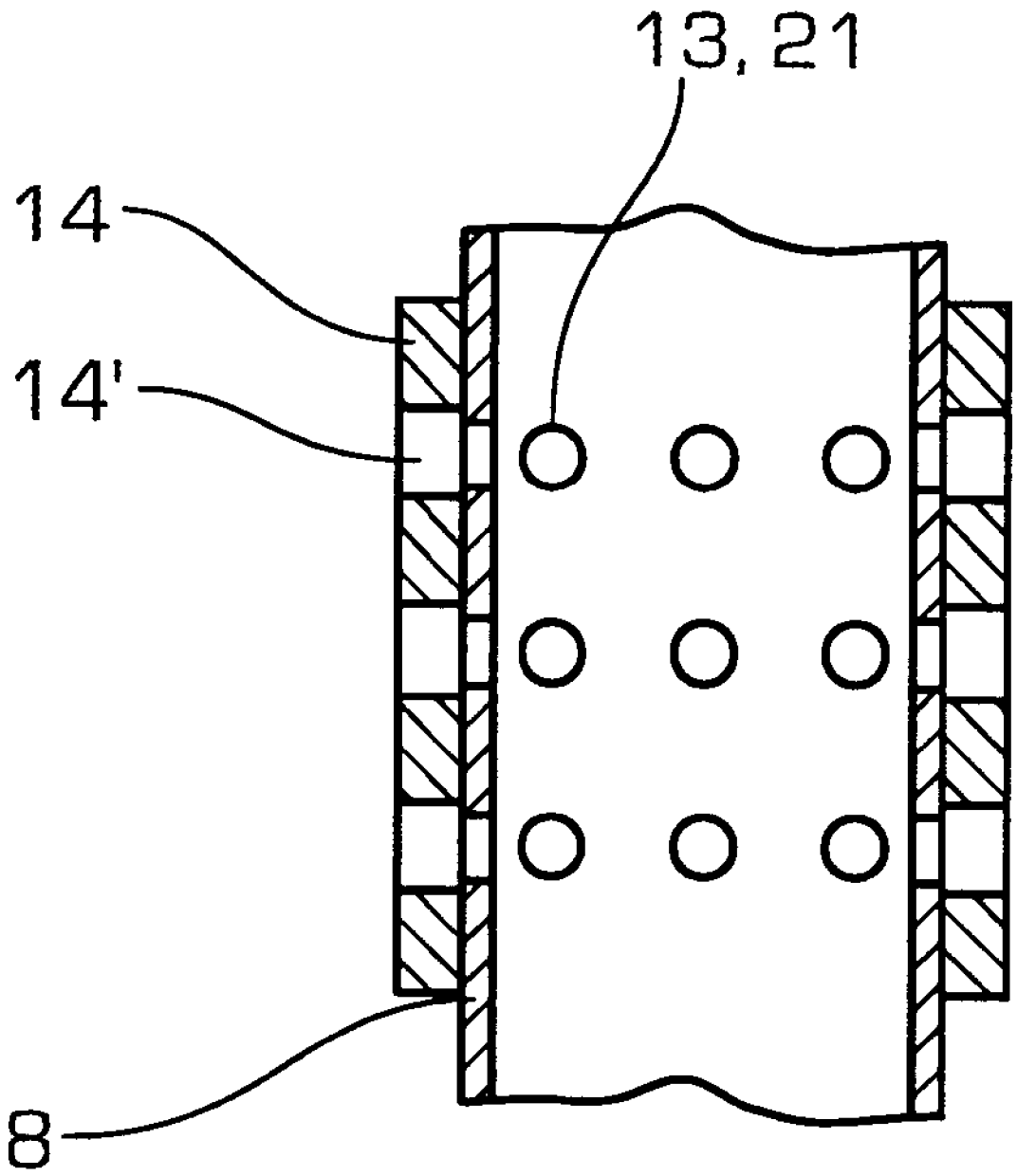
Figure 2:
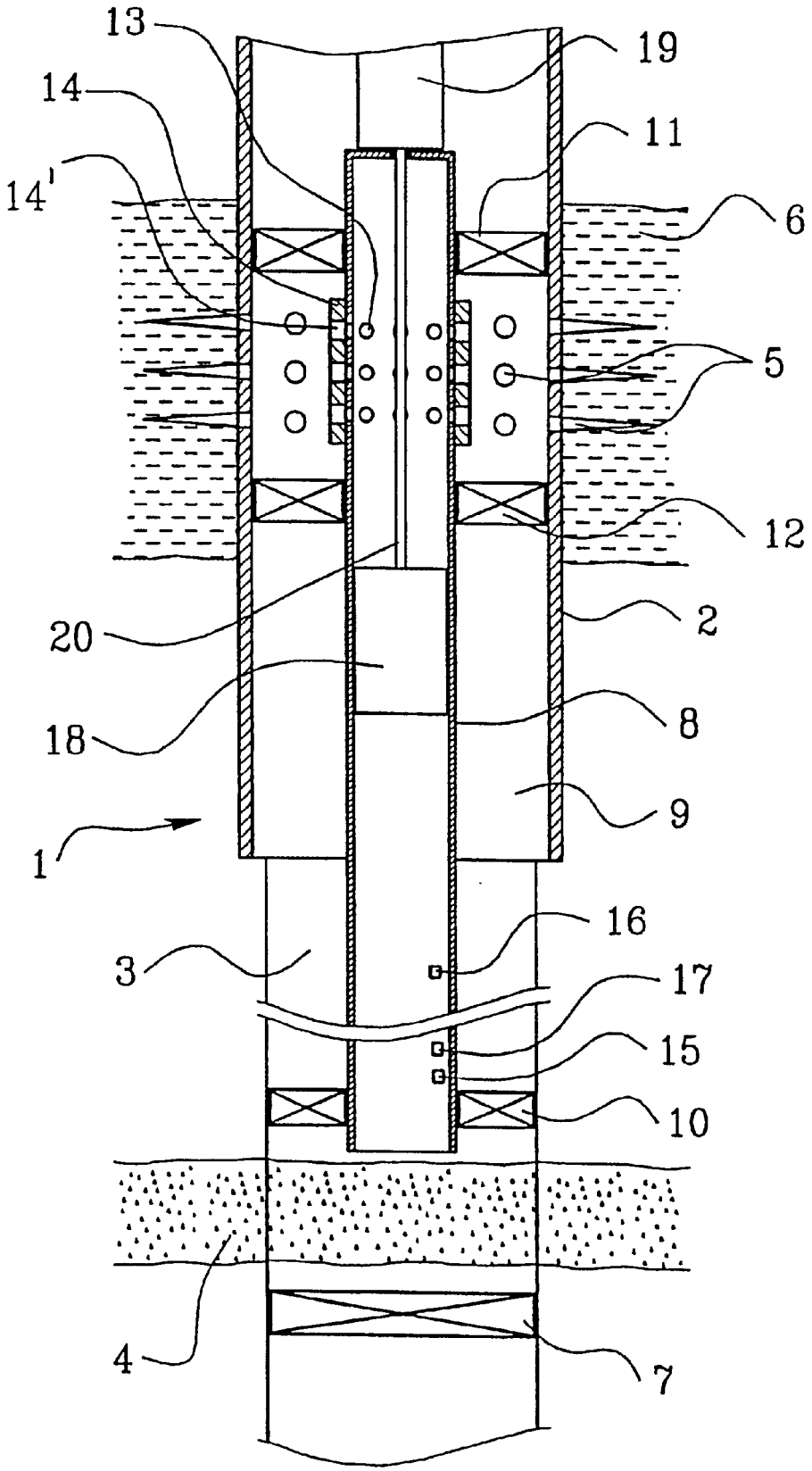

A non-restricting exemplary embodiment of an apparatus for carrying out the invention, is further described in the following, reference being made to the attached drawings, in which:

FIG. 1 shows, diagrammatically and in a side elevational view, a part of a principle sketch of a well where a channel has been disposed which connects two permeable formations;

FIG. 1*a* corresponds to FIG. 1, but here is shown a minor modification of the channel-forming pipe establishing the fluid flow path between the two formations, the bore hole through said second formation not being lined;

FIG. 1*b* shows an expanded view of a lateral gate valve;

FIG. 2 shows a part of a well having a channel, corresponding to FIG. 1, and where a pump has been disposed.

DETAILED DESCRIPTION OF THE PREFERRED EMBODIMENTS

In FIG. 1, reference numeral 1 denotes a part of a vertical well lined with a casing 2. The well 1 is extended with an open (not lined) hole 3 drilled through a first, expected permeable formation 4 to be production tested. The casing 2 is provided with a perforation 5 in an area where the well 1 passes through a second, permeable formation 6.

According to FIG. 1*a*, second permeable formation 6 is not insulated by means of casings (2 in FIG. 1).

First formation 4 is insulated from possible permeable formations adjacent the bottom of the well by means of a bottom packer 7. A tubular channel 8 extends concentrically with the well 1 from the area at first formation 4 to a place above the perforations 5. Thus, an annulus 9 is formed between the channel 8 and the wall defining the open hole 3 and between the channel 8 and the casing 2.

A lower annular packer 10 placed further from the bottom of the well 1 than first permeable formation 4, defines the lower end of the annulus 9.

An upper annular packer 11 placed further from the bottom of the well 1 than the perforations 5, defines the upper end of the annulus 9.

An intermediate annular packer 12 placed closer to the bottom of the well 1 than the perforations 5, prevents communication between the perforations 5 and possible other permeable formations above the lower packer 10.

The channel 8 is closed at the upper end and, according to FIGS. 1 and 2, open at the lower end. In an area distanced from the upper end of the channel 8, below the place where the upper packer 11 is mounted, the channel 8 is provided with gates 13 establishing a fluid communication between the channel 8 and the annulus 9 outside the channel. Thus, fluid may flow from the first formation 4 to the well 1 and into the channel 8 at the lower end thereof, through the channel 8 and out through the gates 13 and further, through the perforations 5, to second formation 6.

In accordance with FIG. 1*a*, there is no need here for the perforations 5 in FIGS. 1 and 2. The annulus packers 11 and 12 will then act against the wall defining the bore hole. The packer 7 can also be a part of the channel-forming pipe 8 when the pipe wall is perforated (21) between the packer 7 and the packer 10.

When the annulus packer 7 is mounted to the channel-forming pipe 8, the latter may be closed at the lower end thereof which, according to FIG. 1*a*, is positioned below the first, expected permeable formation layer 4. In an area above the annulus packer 7, the channel-forming pipe 8 is, thus, provided with through-going lateral gates 21 (see FIG. 1*b* as well) which, together with the through-going lateral gates 13, establish fluid communication between the formations 4, 6.

In the channel 8, a remotely operable valve 14 is disposed, said valve being adapted to control a fluid flow through the channel 8. The valve may, as known per se, comprise a remotely operated displaceable, perforated sleeve 14 adapted to cover the gates 13, wholly or in part, the radially directed holes 14' of the sleeve 14 being brought to register more or less with the gates 13 or not to register therewith.

Further, in the channel 8, remotely readable sensors are disposed, inclusive a pressure sensor 15 and a flow sensor 16 and a temperature sensor 17. As shown in FIG. 2, the channel 8 may be assigned a pump 18 adapted to drive a flow of fluid through the channel 8.

The pump can be driven by a motor 19 placed in the extension of the channel 8. As known, a drive shaft 20 between motor 19 and pump 18 is passed pressure-tight through the upper closed end of the channel 8.

Advantageously, the motor 19 may be of a hydraulic type, adapted to be driven by a liquid, e.g. a drilling fluid which, as known, is supplied through a drill string or a coilable tubing, not shown. Also, an electrical motor can be used which can be cooled through the circulation of drilling liquid or through conducting fluid flowing in the channel 8, through a cooling jacket of the motor 19.

In the annulus 9, sensors may be disposed, in order to sense and point out communication or cross flowing to or from the permeable layers, above or below the annulus.

What is claimed is:

1. A production test method for production testing an expected permeable first formation subjected to subsurface formation pressure, said first formation being penetrated by a well, comprising:

establishing at least one defined fluid flow channel between said first formation and a permeable second formation subjected to subsurface formation pressure, said second formation also being penetrated by the well, and said formations being situated at different levels of the well, which formations are expected not to be in fluid communication with one another outside of the well, the fluid flow channel(s) thus providing the only fluid communication means between said formations;

conducting, entirely within the well, a reservoir fluid provided by the first formation through said fluid flow channel(s) to the permeable second formation, which second formation receives and keeps said fluid at least temporarily, utilizing, in a well situation where the formation pressure of the first formation exceeds the formation pressure of the second formation, a natural formation pressure differential between said formations to conduct said fluid, or utilizing, in a well situation where the formation pressure of the first formation is less than the formation pressure of the second formation, or in a well situation where the pressure of the first formation is insufficient for providing fluid flow, a pump means connected to said at least one fluid flow channel to provide sufficient pressure to conduct said fluid between said formations; and subjecting said reservoir fluid flowing between said formations and along said fluid flow channel(s) to production test measurements, including measurements of fluid pressure and flow rate.

2. The method according to claim 1, wherein the method comprises establishing said at least one defined fluid flow channel by means of at least one channel-forming pipe positioned within a surrounding bore hole or casing that extends between said first and second formations, the or each channel-forming pipe being provided with at least one opening adjacent each of said formations, and the method further comprises placing sealing means with said channel-forming pipe(s) to confine said reservoir fluid to flowing between said formations through said channel-forming pipe (s) and openings only.

3. The method according to claim 2, wherein the method comprises, after having transferred said fluid from the first formation to the second formation, a reversed production test technique which involves forcedly returning the previously transferred fluid from the second formation to the first formation while subjecting said fluid to production test measurements.

4. The method according to claim 2, wherein the method, prior to the production test, comprises a step of fracturing said first formation, which step involves supplying said at least one channel-forming pipe with pressurized liquid through a conduit connected to the channel-forming pipe and extending to the surface.

5. The method according to claim 1, wherein the method comprises, after having transferred said fluid from the first formation to the second formation, a reversed production test technique which involves forcedly returning the previously transferred fluid from the second formation to the first formation while subjecting said fluid to production test measurements.

6. The method according to claim 1, wherein the method, prior to the production test, comprises a step of fracturing said first formation, which step involves supplying said at least one defined fluid flow channel with pressurized liquid through a conduit connected to said fluid flow channel(s) and extending to the surface.

7. An apparatus to be mounted in a well penetrating an expected permeable first formation to be production tested and, at a different level of the well, a permeable second formation, both formations being subjected to subsurface formation pressures, which formations are expected not to be in fluid communication with one another outside of the well, comprising:

at least one channel-forming pipe positioned within a surrounding bore hole or casing of the well, the or each channel-forming pipe extending between the first and second formations and being provided with at least one opening adjacent said first formation, and at least one opening adjacent said second formation;

sealing means positioned with said channel-forming pipe (s), which means are sealingly arranged within the well to provide flow restrictions that confine a reservoir fluid to flowing between said formations through said channel-forming pipe(s) and openings only;

control means positioned with said channel-forming pipe (s), the control means controlling fluid flow rate through said channel-forming pipe(s); and at least one sensor or meter provided with said channel-forming pipe(s) for sensing, measuring or recording at least one property of said fluid flowing through said channel-forming pipe(s), including measurements of fluid pressure and fluid flow rate.

8. The apparatus according to claim 7, wherein the or each channel-forming pipe, in a position above and below said opening(s) adjacent the first formation, and in a position above and below said opening(s) adjacent the second formation, is provided with a well packer placed outside of the or each channel-forming pipe and sealingly engaging with said bore hole or casing, thus providing the or each channel-forming pipe with a cooperating pair of packers placed about the opening(s) adjacent each of said formations, and where said positions of each cooperating pair of packers correspond to a well level that include, wholly or partially, one or the other of said formations, thus confining said reservoir fluid to flowing between packers of said cooperating pairs of packers.

9. The apparatus according to claim 7, wherein the or each channel-forming pipe is open at an end closest to said first formation and is closed at an opposite end, and a portion of the or each channel-forming pipe situated within said second formation is provided with at least one lateral gate through which said fluid can flow.

10. The apparatus according to claim 9, wherein the gate(s) in the portion of the or each channel-forming pipe is provided with a remotely operable displaceable, perforated sleeve which, upon displacement in relation to lateral gate(s) in said portion(s), provides unthrottled or throttled ingoing/outgoing flow of fluid or closure of the fluid flow.

11. The apparatus according to claim 7, wherein the or each channel-forming pipe is closed at both axial ends, and a portion of the or each channel-forming pipe situated within said first formation and, similarly, a portion of the or each channel-forming pipe situated within said second formation each is provided with at least one lateral gate through which said fluid can flow.

12. The apparatus according to claim 11, wherein the gate(s) in each portion of the or each channel-forming pipe is provided with a remotely operable displaceable, perforated sleeve which, upon displacement in relation to lateral gate(s) in said portions, provides unthrottled or throttled ingoing/outgoing flow of fluid or closure of the fluid flow.

13. The apparatus according to claim 7, wherein the or each channel-forming pipe is provided with a remotely operable pump means for displacing said reservoir fluid between said formations.

14. The apparatus according to claim 7, wherein the or each channel-forming pipe is provided with a remotely operable valve adapted to control and adjust the fluid flow through said pipe(s).

* * * * *